US006279429B1

(12) United States Patent
Boyer

(10) Patent No.: US 6,279,429 B1
(45) Date of Patent: Aug. 28, 2001

(54) ADJUSTABLE WRENCH

(76) Inventor: Michael A. Boyer, 271 Kathy Dr., Bourbanais, IL (US) 60914

( * ) Notice: Subject to any disclaimer, the term of this patent is extended or adjusted under 35 U.S.C. 154(b) by 0 days.

(21) Appl. No.: 09/361,378

(22) Filed: Jul. 27, 1999

(51) Int. Cl.[7] ..... B25B 13/14
(52) U.S. Cl. ..... 81/159; 81/155; 81/165
(58) Field of Search ..... 81/DIG. 5, 129, 81/155, 159, 165

(56) References Cited

U.S. PATENT DOCUMENTS

| | | | | |
|---|---|---|---|---|
| 162,500 | | 4/1875 | Rost . | |
| 245,290 | | 8/1881 | Fink . | |
| 300,145 | | 6/1884 | Simon . | |
| 370,848 | | 10/1887 | Barber . | |
| 783,845 | | 2/1905 | Munro . | |
| 953,346 | | 3/1910 | Newbauer . | |
| 1,846,380 | * | 2/1932 | Anderson | 81/DIG. 5 X |
| 2,458,794 | * | 1/1949 | Ogden | 81/165 |
| 2,729,999 | * | 1/1956 | Barnes | 81/165 |
| 3,901,107 | * | 8/1975 | Halls | 81/165 X |
| 3,948,120 | * | 4/1976 | Hancock | 81/DIG. 5 X |
| 5,644,957 | * | 7/1997 | Gustafson | 81/165 |

* cited by examiner

*Primary Examiner*—Joseph J. Hail, III
*Assistant Examiner*—Anthony Ojini
(74) *Attorney, Agent, or Firm*—Fitch, Even, Tabin & Flannery

(57) ABSTRACT

The present invention is directed to an adjustable wrench that permits quick and effortless speed slip adjustment and locked positioning.

4 Claims, 6 Drawing Sheets

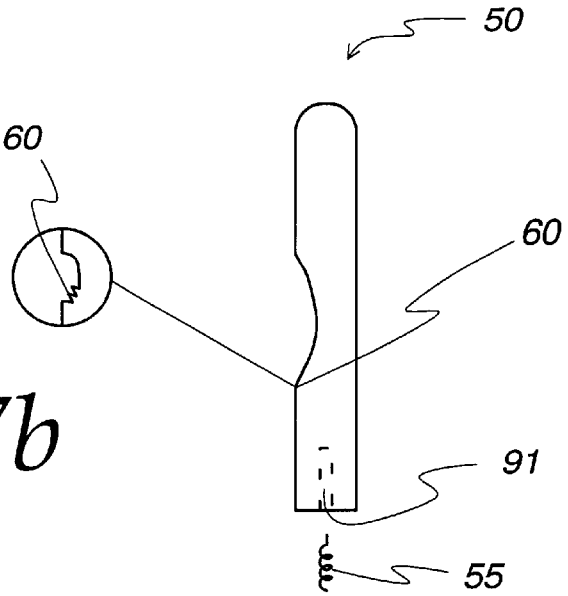
Fig. 7a
Fig. 7b
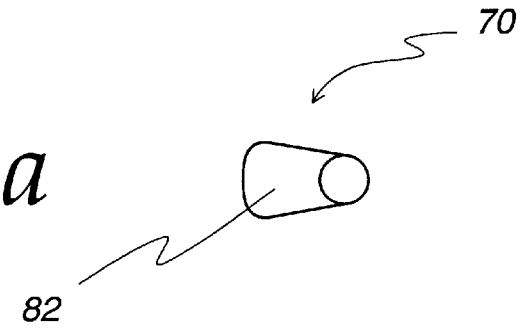
Fig. 8a
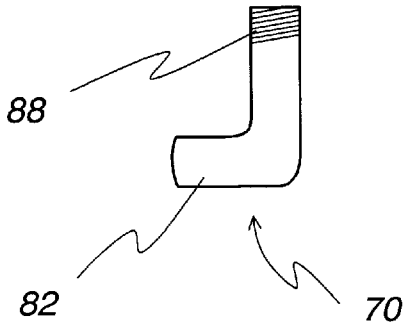
Fig. 8b

ADJUSTABLE WRENCH

The present invention relates generally to adjustable wrenches, and more specifically to a wrench which permits easy adjustment and locked positioning due to a singly-grooved screw adjust assembly.

BACKGROUND

Adjusting a wrench to conform to the size of the object being torqued stands as a cumbersome and unwieldy task. Most wrenches require the user to make tedious macro-adjustments by screwing a moveable jaw into position. Upon nearing the correct position, these wrenches then require the user to guess and check iteratively to ensure the exact micro-adjustment. As most pipes, bolts, and screws are not readily accessible, this procedure becomes a frustrating exercise. Other wrench manufacturers produce an entire set of wrenches in different sizes, both metric and English in order to overcome this problem.

Some effort has been made to alleviate this problem by producing a single wrench capable of easy macro-adjustment. U.S. Pat. No. 783,845 teaches a wrench allowing for easy movement of the floating jaw, which apparently slides freely when the thrice-mutilated threads of the nut and the rock-stem are out of alignment. Moreover, U.S. Pat. No. 953,346 teaches a wrench that includes a moveable jaw which slides into position when the twice interrupted threads are not engaged.

These efforts, heretofore, however, have suffered serious deficiencies. Each wrench is very expensive and difficult to manufacture. Twice and thrice interrupted thread designs require extensive machining, including potentially, extensive exterior and interior machining. In addition, these efforts produce wrenches prone to slippage of the jaws, even once locked into position. Multiple thread interruptions do not provide a jaw locked into position securely enough for most high torque applications. Moreover, multiple thread interruptions allow for the additional possibility of the threads disengaging entirely, and the jaws of the wrench falling open during use.

Indeed a need exists for a wrench which allows for easy adjustment due to a singly grooved screw adjust assembly. Such a wrench could be produced in a cost-efficient manner and without the need for extensive machining. Moreover, such a wrench would lock into position securely, without the fear of the jaws slipping or falling open during use.

SUMMARY

The present invention describes a wrench that permits quick and effortless speed slip adjustment and locked positioning. The wrench includes a singly grooved interrupted screw adjust driver 1. When the single groove 5 of the screw adjust driver 1 is aligned with serrated teeth 21 along a shank 22 of a floating jaw 20, the floating jaw 20 is freely movable to a desired position. Once the floating jaw 20 attains the desired position, the screw adjust driver 1 may be turned to engage the serrated teeth 21 of the floating jaw 20 and lock the floating jaw 20 into place In an important aspect of the invention, the wrench employs a handle 10 that is continuous with a wrench body 12 and a fixed jaw 15. The wrench body 12 includes a slot 27 configured to receive an adjustable shank 22 of a floating jaw 20. The floating jaw 20, with serrated teeth 21 along an adjustable shank 22, slides inside the body of the wrench when the serrated teeth 21 are not engaged by helical threads 25 of the screw adjust driver 1.

Once the floating jaw 20 attains a desired position, the screw adjust driver 1 may be turned, engaging the helical threads 25 of the screw adjust driver 1 and the serrated teeth 21 of the floating jaw 20, and holding the floating jaw into position. This strong and secure engagement allows for maximum torque without slippage. Micro-adjustment may be accomplished, without any compromise in torque, by further turning the screw adjust driver 1 up to one revolution, such as for example ¾ to ⅞ of one revolution or 85% of one revolution.

The jaws of the wrench may be manufactured as forged jaws or as replaceable machined-insert jaws held, for example, by rivets, rollpins, or machine screws. In an important aspect of the invention, machine-insert jaw are cost-efficiently produced and may be easily replaced upon breakage, thereby extending the life and usefulness of the wrench. Forged jaws or machined-insert jaws may be produced in any style, for example, radius serrated jaws 30, straight serrated jaws 31, or standard straight jaws 32. In another important aspect of the invention, radius serrated jaws 30 find particular application in pipe work.

The floating jaw 20 slides inside the body of the wrench by a singly-grooved, interrupted thread screw adjust driver 1 mounted upon an assembly shaft 2. The assembly shaft 2., for example, may be a key-way shaft or a straight shaft. A shaft keeper 8 ensures that the assembly shaft 2 remains in position. In an important aspect of the invention, the assembly shaft 2 and screw adjust driver 1 may be removed entirely from the wrench by unscrewing the shaft keeper 8. In this way, the assembly shaft 2 and screw adjust driver 1 may be machined individually, thereby reducing the cost and effort required to manufacture the wrench as well as providing for easy replacement parts, thereby increasing the life and usefulness of the wrench.

The screw adjust driver includes, for example, a helical thread design 25. When the single groove 5 in the screw adjust driver 1 envelops the teeth of the floating jaw 20, the floating jaw 20 may be moved up and down quickly and effortlessly to conform to the size of the object being adjusted. The wrench also may be pre-configured according to the Society of Automotive Engineers' (SAE) standards or the metric scale 40 on the body of the wrench 12. In an important aspect of the invention, ball stop 45 and ball stop receiving area 46, inserted on the floating jaw and in slot 27, respectively, prevent the floating jaw 20 from detaching completely from the body of the wrench unless so desired.

In an alternative aspect of the invention, the screw adjust driver 1, and hence the jaws of the wrench, can be additionally locked into place by means of a push button lock 50. When the push button lock 50 is not depressed, locking teeth 60 are engaged, locking the screw adjust driver 1, and hence, the jaws of the wrench into place. When the push button lock 50 is depressed, locking teeth 60 are disengaged allowing the screw adjust driver 1 to move freely, and hence, allowing the jaws of the wrench to be freely positioned. In assisting this operation may be a hold down assembly 70 so that the screw adjust driver 1 may be turned using one hand.

BRIEF DESCRIPTION OF THE DRAWINGS

FIG. 7*a* shows a push button lock assembly.

FIG. 7*b* shows an enlarged view of the locking teeth.

FIG. 8*a* shows a top view of a push button hold down assembly.

FIG. 8*b* shows a side view a push button hold down assembly.

DETAILED DESCRIPTION

Figure 1:
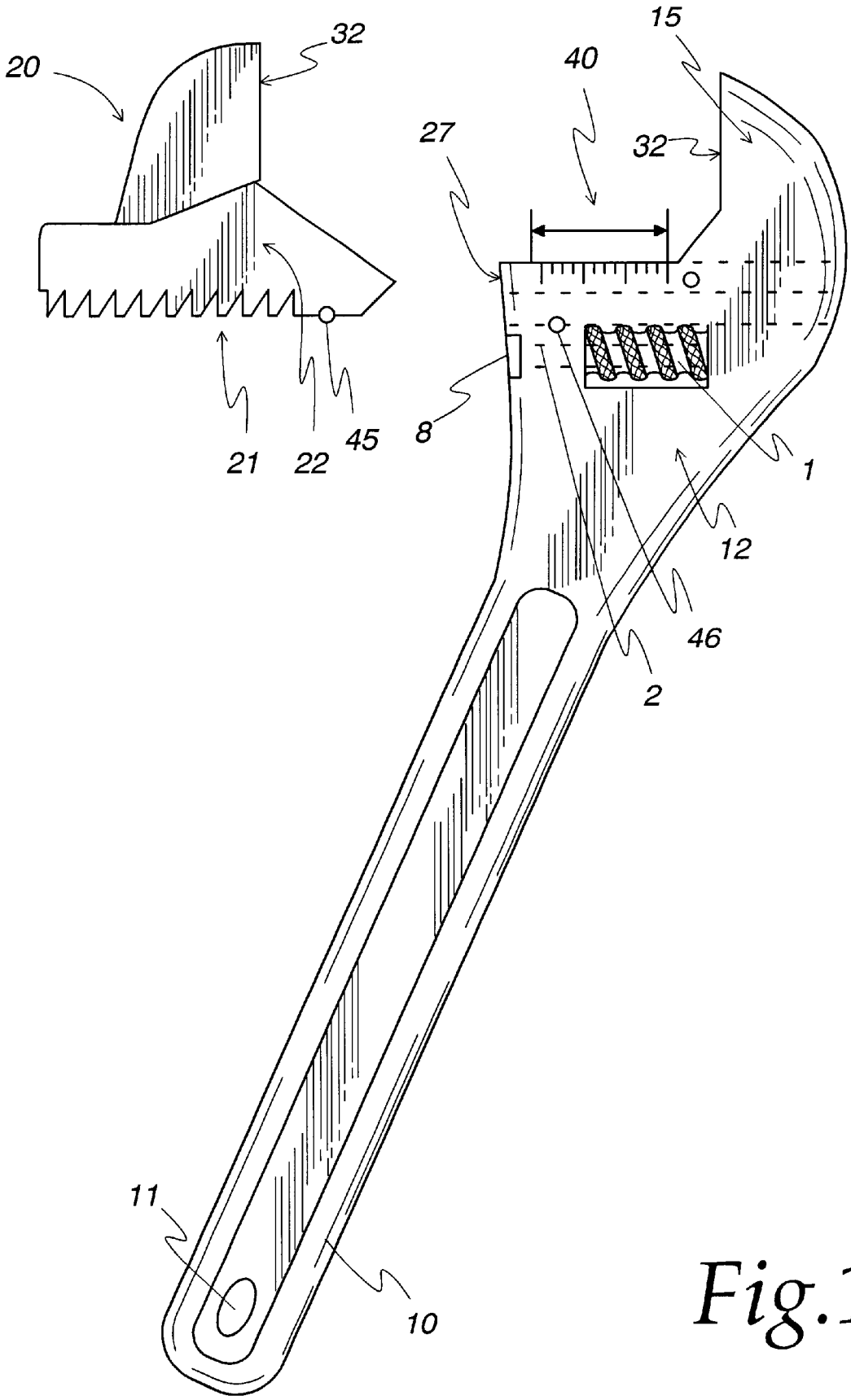
FIG. 1 shows the adjustable wrench of the present invention with straight jaws in crescent wrench style.

FIG. 1 shows one aspect of the wrench of the present invention with an ordinary straight or cresent handle design. In this aspect of the invention, it is understood that the wrench may be configured with a straight or off-set handle design. The wrench comprises a handle 10 and a fixed jaw 15. In an optional aspect of the invention, the handle may contain a hole 11 to facilitate hanging the wrench. The fixed jaw 15 may be forged to be continuous and one piece with the body 12 of the wrench. Alternatively, the fixed jaw 15 may be attached to the body 12 of the wrench, for example by rivets, rollpins or machine screws.

In another aspect of the invention, and as shown in FIG. 1, the wrench further includes a floating jaw 20 with serrated teeth 21 along an adjustable shank 22. The body 12 of the wrench includes a slot portion 27 configured to receive the adjustable shank 22 of the floating jaw 20.

In an important aspect of the invention, the wrench includes an interrupted thread screw adjust driver 1 mounted upon an assembly shaft 2. A shaft keeper 8 ensures that the assembly shaft 2 remains in position, and allows for easy removal and replacement of the assembly shaft 2.

Figure 2A:
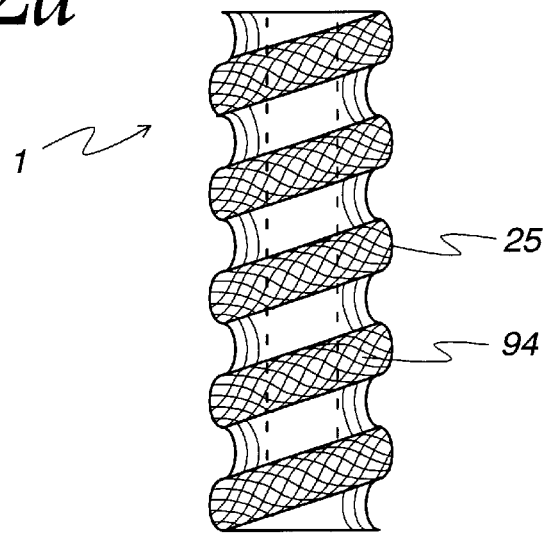
FIG. 2*a* shows a side view of the interrupted thread screw adjust driver without knurled teeth.
Figure 2B:
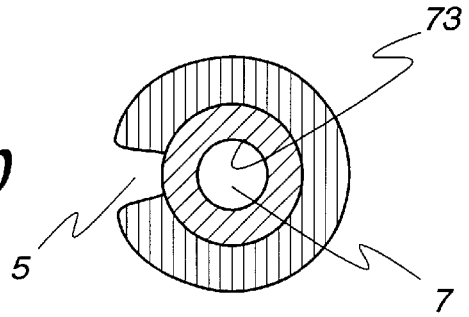
FIG. 2*b* shows a top view of the interrupted thread screw adjust driver.
Figure 2C:
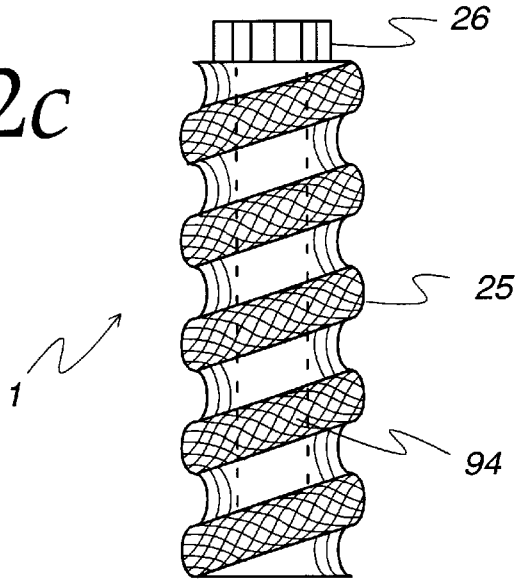
FIG. 2*c* shows a side view of the interrupted thread screw adjust driver with knurled teeth.

FIGS. 2*a*–2*c* show the interrupted thread screw adjust driver 1. The interrupted thread screw adjust driver 1 comprises, for example, a helical thread 25 design. The outside or raised surface 94 of the screw adjust driver includes a knurled surface to assist gripping and for turning of the screw adjust driver 1. In an important aspect of the invention, the screw adjust driver 1 may include at least five helical threads 25 for improving performance and strength of the wrench.

As shown in a top view of the interrupted thread screw adjust driver 1 in FIG. 2*b*, the threads of the screw adjust driver 1 are interrupted with a single groove 5, and the center of the screw adjust driver includes an open assembly shaft channel 7. When the single groove 5 in the screw adjust driver 1 envelops the serrated teeth 21 of the floating jaw 20, the floating jaw 20 may be moved up and down quickly and effortlessly to conform to the size of the object being adjusted. In an important aspect of the invention, the interrupted thread screw adjust driver 1 may include knurled teeth 26 as shown in FIG. 2*c*, or may not have knurled teeth as shown in FIG. 2*a*.

Figure 3A:
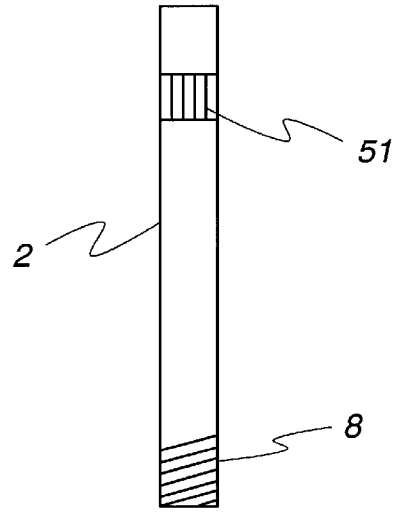
FIG. 3*a* shows a side view of an assembly shaft.
Figure 3B:
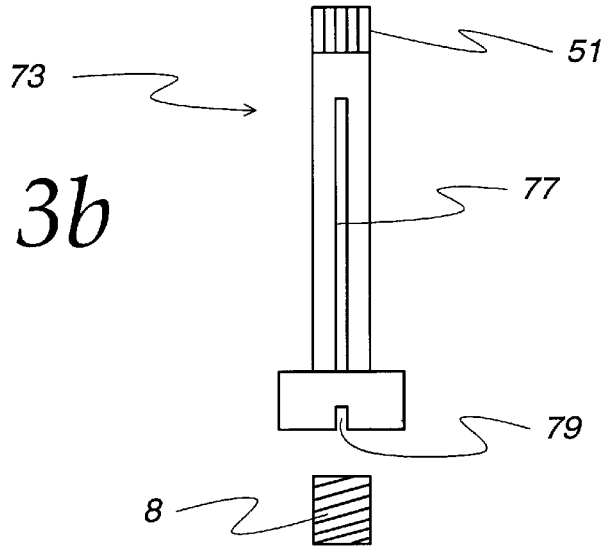
FIG. 3*b* shows a side view of a key-way shaft.

In another aspect of the invention, the interrupted thread screw adjust driver 1 mounts upon an assembly shaft 2. As shown in FIG. 3, the assembly shaft 2 is held in place by a shaft keeper 8. In this aspect of the invention, the shaft keeper 8 may be attached to the assembly shaft 2 or may be a separate from the assembly shaft 2. The assembly shaft 2 may be a straight shaft as shown in FIG. 3*a* or a key-way type shaft 73 as shown in FIG. 3*b*. In the aspect of the invention that include a push button lock assembly 50, the assembly shaft 2 may further include an engagement surface 51 that is configured to engage the interrupted thread screw adjust driver 1 or the push button lock assembly 50. In the aspect of the invention shown in FIG. 3*b*, the key-way type shaft 73 includes a driver key-way 77 and pull out threads 79. The key-way type shaft 73 is maintained in place by a shaft keeper 8. FIG. 2*b* shows a top view of the adjust driver 1 where a key-way shaft 73 is used.

Figure 4:
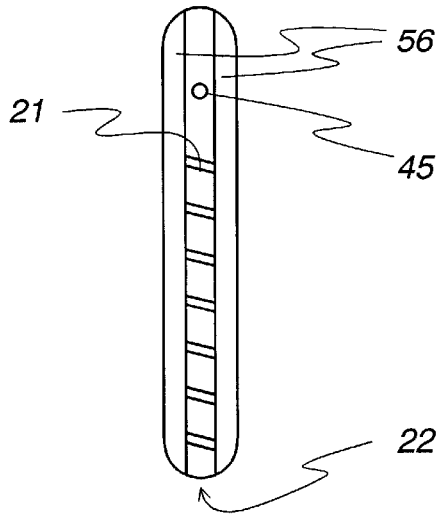
FIG. 4 shows a side view of a floating jaw.

In another aspect of the invention, the fixed jaw 15 and floating jaw 20 may be produced in any style, for example, as standard straight jaws 32 as shown in FIG. 1, straight serrated jaws 31 as shown in FIG. 4, or radius serrated jaws 30 as shown in FIG. 5*b*. All jaw types may be produced as inserts that are held onto the jaw of the wrench by any means known in the art, such as for example by rivets. Serrated jaws may provide improved performance for certain types of applications.

FIG. 4 shows a side view of a floating jaw of the invention. The jaw includes serrated teeth 21 along an adjustable shank 22 and a ball stop 45. The floating jaw may further include precision ground surfaces 56 which are configured to slide into slot 27 to allow for free and smooth adjustment when the serrated teeth 21 of the jaw are not engaged by the screw adjust driver 1.

Figure 5:
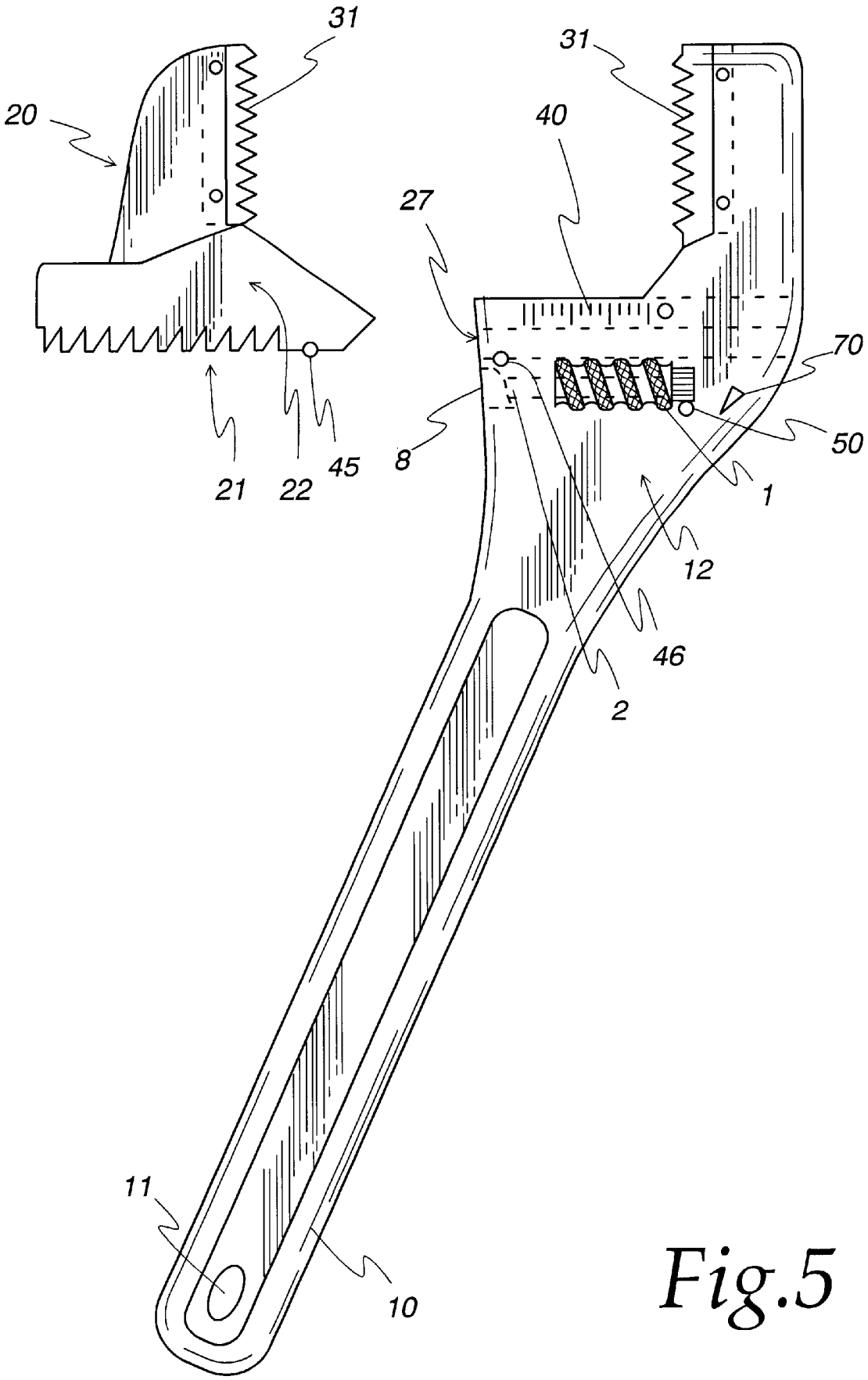
FIG. 5 shows the adjustable wrench of the present invention with serrated jaws which can be used as a crescent wrench or pipewrench.

FIG. 5 shows a side view of the adjustable wrench of the present invention with serrated jaws. In an important aspect of the invention, this type of wrench design can be utilized both as crescent wrench and as a pipe wrench. Hence, this type of wrench provides a user with a single wrench that can be used for multiple types of jobs.

In another aspect of the invention, the jaws may also be pre-configured using the SAE or metric scales 40 on the floating jaw 20, fixed jaw 15, or body 12 of the wrench. In an important aspect of the invention, a ball stop 45 and ball stop receiving area 46, are inserted on the floating jaw 20 and the inside of slot 27 respectively to prevent the floating jaw 20 from detaching completely from the body 12 of the wrench. The floating jaw 20 may be completely removed with additional effort to remove the floating jaw 20 from the body 12 of the wrench. Alternatively, and as shown in FIGS. 6*a* and 6*c*, rather than ball stop 45 and ball stop receiving area 46, the wrench may include an allen button head screw 99 to prevent the floating jaw 20 from being completely removed from the body 12 of the wrench.

Figures 6A, 6B, 6C:
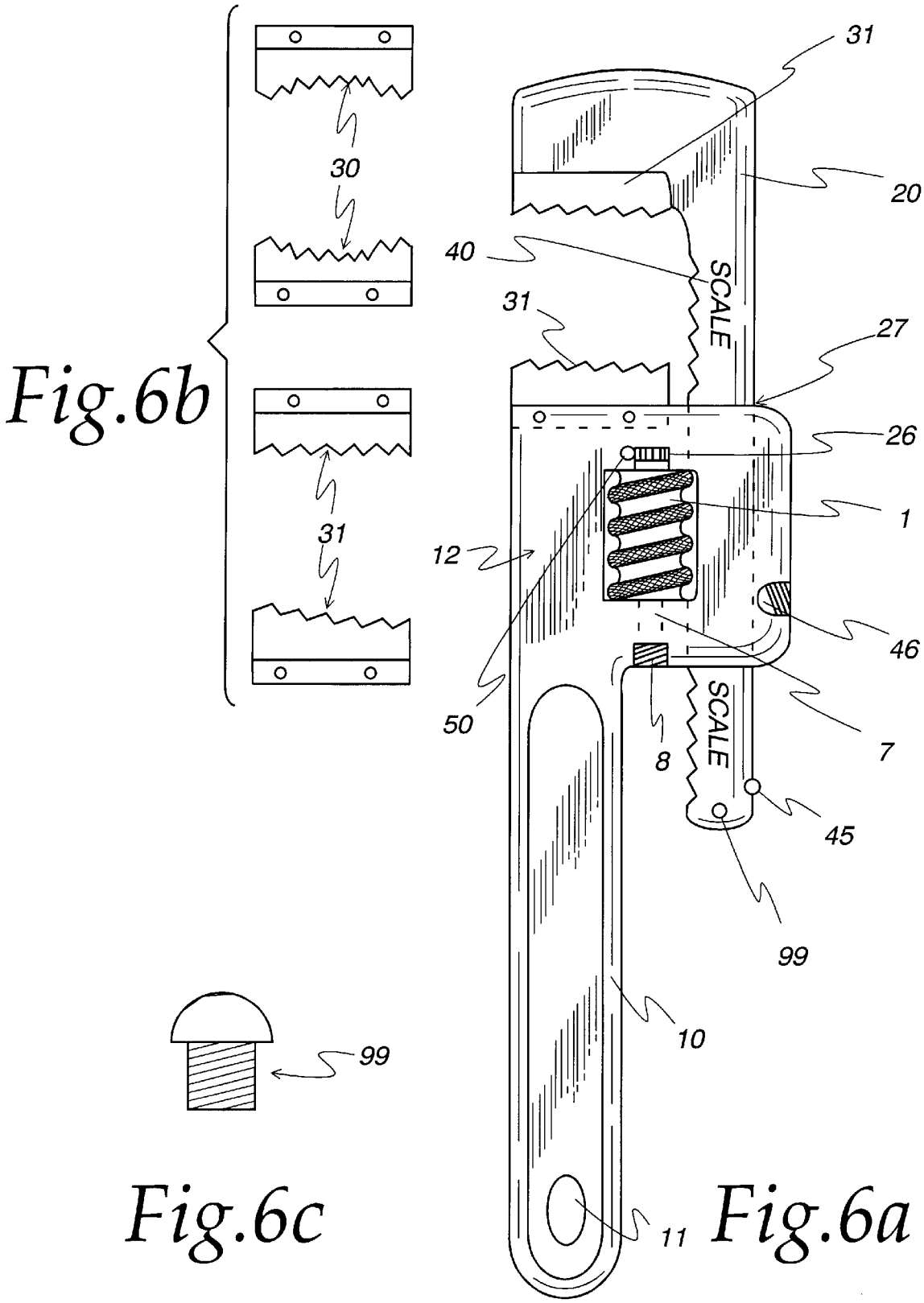
FIG. 6*a* shows the adjustable wrench of the present invention in a pipe wrench style.
FIG. 6*b* shows radius and straight serrated jaws.
FIG. 6*c* shows an alien button head screw.

In an alternative aspect of the invention, the screw adjust driver 1, and hence the jaws of the wrench, may be additionally locked into place by means of a push button lock assembly 50, as shown in FIGS. 5, 6*a* and 7. When the push button lock assembly 50 is not depressed, for example in an up or open position, locking teeth 60 of the push button lock assembly 50 engage either the assembly shaft 2 or the knurled teeth 26 atop the screw adjust driver 1, thereby locking the screw adjust driver 1, and hence, the jaws of the wrench, into place. A pressure spring 55 is contained into a spring receiving shaft 91 and biases the push button lock assembly 50 in an open or up position such that the locking teeth 60 are engaged. When the push button lock assembly 50 is depressed, locking teeth 60 (shown in more detail in FIG. 7*b*) are disengaged allowing the screw adjust driver 1 to move and allowing the jaws of the wrench to be freely positioned.

FIG. 6*a* shows a pipe wrench design of the present invention. Knurled teeth 26 may be positioned as shown or turned such that the knurled teeth 26 are on the opposite side. In an alternative aspect of the invention, the assembly shaft 7 may be placed opposite as shown such that the shaft keeper 8 is positioned under the jaw insert.

In an optional aspect of the invention, the push button lock assembly 50 may be held in a closed or disengaged position through the use of a push button hold down assembly 70 mounted on the body of the wrench 12 (as shown in FIG. 5). This type of assembly is commonly referred to as a "duck's foot" type of closure. A locking flap 82 may be positioned over the push button lock assembly 50 to maintain the lock assembly in an disengaged position. The push button lock assembly hold down assembly 70 is further illustrated in FIGS. 8*a–b*. The flap 82 of the push button hold down assembly 70 is formed with a pivotably adjustable shank 88 that allows the flap 82 to be moved from a position over the push button lock assembly 50 to a position such that the flap is not over the push button hold down assembly 70.

What is claimed is:

1. An adjustable wrench comprising:

a handle, a wrench body and a fixed jaw;

a floating jaw having serrated teeth along an adjustable shank; and a singly-grooved, interrupted thread screw adjust driver mounted upon an assembly shaft, wherein the thread screw adjust driver includes helical threads that are interrupted by at least one groove that is continuous along an entire length of the thread screw adjust driver and wherein the groove is parallel to the assembly shaft, wherein the assembly shaft is a key-way type shaft, wherein the wrench body includes a slot configured to receive the adjustable shank of the floating jaw, the interrupted thread screw adjust driver being adjustable to engage the serrated teeth of the floating jaw and adjustable to not engage the serrated teeth of the floating jaw.

2. An adjustable wrench according to claim 1, wherein the jaws of the wrench are forged jaws or replaceable machined-insert jaws.

3. An adjustable wrench according to claim 1, wherein the jaws of the wrench are radius serrated jaws, straight serrated jaws, or standard straight jaws.

4. An adjustable wrench according claim 1, further comprising a shaft keeper.

* * * * *